US011123978B2

(12) United States Patent
Pforte et al.

(10) Patent No.: US 11,123,978 B2
(45) Date of Patent: Sep. 21, 2021

(54) PROCESSING MACHINE HAVING A UNIT WITH A RESERVOIR, AND METHOD FOR OPERATING A RESERVOIR

(71) Applicant: KOENIG & BAUER AG, Würzburg (DE)

(72) Inventors: Detlev Pforte, Radebeul (DE); Lutz Halbach, Coswig (DE); Jan Teller, Dresden (DE); Peter Jentzsch, Weinböhla (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/769,386

(22) PCT Filed: Dec. 7, 2018

(86) PCT No.: PCT/EP2018/083986
§ 371 (c)(1),
(2) Date: Jun. 3, 2020

(87) PCT Pub. No.: WO2019/110807
PCT Pub. Date: Jun. 13, 2019

(65) Prior Publication Data

US 2020/0376828 A1 Dec. 3, 2020

(30) Foreign Application Priority Data

Dec. 7, 2017 (DE) ..... 10 2017 222 158.5

(51) Int. Cl.
*B41F 31/04* (2006.01)
*B41F 9/06* (2006.01)
(Continued)

(52) U.S. Cl.
CPC ..... *B41F 31/04* (2013.01); *B41F 9/066* (2013.01); *B41F 9/068* (2013.01); *B41F 31/05* (2013.01);
(Continued)

(58) Field of Classification Search
None
See application file for complete search history.

(56) References Cited

U.S. PATENT DOCUMENTS 2,887,050 A * 5/1959 Moser ..... B41F 31/025 101/364
3,032,007 A * 5/1962 McCauliff ..... D21H 5/0017 118/407
(Continued)

FOREIGN PATENT DOCUMENTS

DE 8817107 U1 10/1992
DE 4330047 C2 2/1997
(Continued)

OTHER PUBLICATIONS

International Search Report of PCT/EP2018/083986 dated Mar. 26, 2019.

*Primary Examiner* — Jill E Culler
(74) *Attorney, Agent, or Firm* — Mattingly & Malur, PC

(57) ABSTRACT

A processing machine, in particular a printing machine, includes a unit having a storage container. The storage container comprises a roller and a base which delimit the storage chamber for a medium. One or more sliders are arranged along the edge of the base to form, together with the roller, an outlet gap for the medium. In the region of the one or more sliders, pneumatic means are provided to seal the supply chamber with respect to the medium. A method for operating such a processing machine is also disclosed.

13 Claims, 3 Drawing Sheets

(51) Int. Cl.

| | |
|---|---|
| ***B41F 31/05*** | (2006.01) |
| ***B41F 31/06*** | (2006.01) |
| *B41F 9/10* | (2006.01) |
| *B05C 11/04* | (2006.01) |

(52) U.S. Cl.
CPC ..... *B41F 31/06* (2013.01); *B05C 11/047* (2013.01); *B41F 9/1063* (2013.01); *B41F 9/1072* (2013.01)

(56) References Cited

U.S. PATENT DOCUMENTS

| | | | | |
|---|---|---|---|---|
| 3,186,339 | A | 6/1965 | Turner et al. | |
| 4,165,688 | A | 8/1979 | Jorgensen et al. | |
| 4,434,194 | A * | 2/1984 | Gebert | B05C 11/047 118/410 |
| 4,773,327 | A | 9/1988 | Moetteli | |
| 4,854,234 | A | 8/1989 | Emery et al. | |
| 4,924,802 | A * | 5/1990 | Knop | D21H 5/0015 118/410 |
| 5,461,979 | A * | 10/1995 | Bruni | B41F 31/04 101/365 |
| 6,675,706 | B2 * | 1/2004 | Barker | B41F 7/32 101/147 |
| 2020/0032906 | A1 | 1/2020 | Elber-Schrichten et al. | |

FOREIGN PATENT DOCUMENTS

| | | | |
|---|---|---|---|
| DE | 19623349 | A1 | 12/1997 |
| DE | 102007003943 | A1 | 7/2008 |
| FR | 1416866 | A | 11/1965 |
| WO | 2017/121852 | A1 | 7/2017 |

* cited by examiner

PROCESSING MACHINE HAVING A UNIT WITH A RESERVOIR, AND METHOD FOR OPERATING A RESERVOIR

CROSS REFERENCE TO RELATED APPLICATIONS

The subject application is the U.S. National Phase, under 35 U.S.C. § 371, of PCT/EP2018/083986, filed Dec. 7, 2018; published as WO 2019/110807 A1 on Jun. 13, 2019, and claiming priority to DE 10 2017 222 158.5 filed Dec. 7, 2017, the disclosures of which are expressly incorporated in their entireties herein by reference.

FIELD OF THE INVENTION

The present invention relates to a processing machine, in particular a printing machine, having a unit with a reservoir, and to a method for operating a reservoir in a unit of a processing machine, in particular a printing machine.

BACKGROUND OF THE INVENTION

An ink fountain typically comprises a ductor roller and an ink fountain base, which delimit an ink chamber that during operation is filled with ink, in particular UV printing ink. Arranged in a row along a lower margin of the ink fountain base are a plurality of ink slides, which, together with the ductor roller, form a gap at the ink fountain base of the ink chamber, via which ink is conveyed out of the ink chamber by the rotation of the ductor roller. The distance between ink slide and ductor roller determines the thickness of the ink film that is conveyed out of the ink chamber. This distance can be adjusted for each ink slide individually, so that an ink film having a zonally variable thickness is obtained.

Since the ink slides are in direct contact with the ink in the ink chamber and must be movable relative to one another, there is a possibility that ink may penetrate into a gap between a side panel and an ink slide or between two ink slides, making it harder to clean the ink fountain, which is necessary when the ink is changed, or even impeding the displacement of the ink slides. To prevent this, current practice involves greasing the ink slides during installation, so that grease in the gaps between the side panels and the ink slides and between the ink slides obstructs the pathway to the ink. Since the grease changes color over time, regular regreasing is necessary.

From DE-Gbm 69 47 168 and from DE-OS 1 961 033, a sealing device on inking rollers for printing presses is known, in which a sealing surface is provided between a fixed sealing frame and a ductor roller, said sealing surface having an annular recess for air under positive pressure, which prevents ink from passing through.

Known from DE 32 41 124 A1 is an ink fountain dividing key in an ink fountain of a rotary printing machine, wherein a sealing end face adapted to an ink fountain roller is provided, which has a longitudinal groove into which bore holes lead, said bore holes being connected to a compressed air source via flexible tubes.

Known from WO 2017/121852 A1 is a sealing element for a doctor blade chamber of a flexographic printing machine, wherein a sealing surface bearing against a roller body has a flow outlet opening at which, during operation of the machine, a positive pressure can be built up in a fluid such that the fluid forms a sealing flow film between sealing surface and roller body.

From DE-AS 1 269 138, an ink fountain for a printing machine having a flexible ink blade is known, wherein a pneumatically actuable body extending along the ink blade is attached below the ink blade, and wherein a force that counteracts the pneumatic pressure can be generated locally, in each case via individually adjustable elements.

Known from FR 1,416,866 A is an ink fountain for printing machines, which has an inflatable body, the expansion of which moves the ink blade out of its individual position of adjustment, thereby forcing its edge uniformly against the roller. This is meant to simplify cleaning and accelerate a restart. The inflatable body acts to raise the ink blade without disrupting the individual adjustments of the ink blade and a movement back to its previous position.

From U.S. Pat. No. 4,854,234, an ink fountain closure system is known, which has pneumatic means for closing the outlet gap via inking zone levers. The adjustment elements of the inking zone levers are likewise ineffectual for this.

Known from DE 10 2007 003 943 A1 is an ink reservoir for providing printing ink in printing units of printing machines, in which side panels or ink dividers are connected to the inking roller via sealing means. The sealing means have a compressed air chamber, which is connected to a compressed air supply and which produces a sealing effect with a change in volume.

From DE 88 17 107 U1, a metering blade for the zonal metering of an ink film is known.

A sealing effect in the region of slides, in particular ink slides, or between slides and side walls, cannot be achieved with the aforementioned solutions.

SUMMARY OF THE INVENTION

The object of the present invention is to devise alternative processing machines that have a unit, or an alternative method for operating a reservoir in a unit, in particular a printing unit, of a processing machine.

The object is attained according to the present invention by the provision of a processing machine, such as a printing machine, having a unit that has a reservoir. The reservoir comprises a roller and a base that delimit a reservoir chamber for a medium. One or more slides are arranged along the margin of the base to form, together with the roller, an outlet gap for the medium. Pneumatic means for sealing the reservoir chamber, with respect to the medium, are provided in the region of the slide or slides. The processing machine may be an offset printing machine having a printing unit that has an ink fountain. The ink fountain comprises a ductor roller, an ink fountain base, and end walls, which delimit an ink chamber for the printing ink. The ink fountain is open toward the top. The one or more ink slides, which are arranged along a margin of the ink fountain base, form, together with the ductor roller, an ink outlet gap for the printing ink. In the region of the ink slide or slides, or in the region of an edge between an end wall and the ductor roller, the pneumatic means are provided for sealing the ink chamber with respect to the printing ink. In a method for operating a reservoir in a unit of a processing machine, such as a printing machine, the roller and the base delimit the reservoir chamber of the reservoir for the medium. The one or more slides, which are arranged along a margin of a base, form, together with the roller, an outlet gap for the medium. In the region of the slide or slides, the pneumatic means force in compressed gas for the purpose of sealing the reservoir chamber with respect to the medium.

The present invention offers the advantage that an alternative processing machine, in particular a printing machine, having a unit that has a reservoir, or an alternative method for operating a reservoir in a unit, in particular a printing unit, is provided. Provided in particular is a processing machine, in particular a sheet-fed and/or offset printing machine, that has a corresponding unit, in particular a printing unit.

A processing machine, in particular a sheet-fed and/or rotary offset printing machine, has at least one unit, in particular a printing unit or coating unit, for processing substrates. Preferably, the machine has a plurality of such units, for example of identical construction, for the successive processing of transported substrate. Arranged in such a unit is a reservoir comprising a roller and a base, which together delimit a reservoir chamber for a medium to be supplied to the substrate. One or more slides arranged along a margin of the base, together with the roller, form an outlet gap for the medium, through which the medium can be or is applied to the substrate, for example via a distribution system.

Pneumatic means for sealing the reservoir or the reservoir chamber with respect to the medium held inside the reservoir are provided in the region of the slide(s) or in the region of end faces. The pneumatic means preferably keep the region around the slide(s) below the base, in particular outside of the outlet gap or sealing surfaces of end faces, free of the medium. Particularly preferably, the pneumatic means keep an open space between the surfaces of a side surface and a slide, and/or open spaces between the surfaces of slides free of the medium. To this end, a positive pressure can be generated by the pneumatic means, this pressure being a pressure that lies above the ambient pressure. This positive pressure is vented or released in such a way that it reduces or prevents the medium, in particular the printing ink or UV printing ink, from penetrating into the open spaces, in particular gaps. Thus the pneumatic means particularly preferably extend uninterrupted across the slide or across all the slides that are provided between the side walls that delimit the reservoir chamber.

Preferably, a processing machine, in particular a sheet-fed or rotary offset printing machine, is configured as having one or more printing units, in which or in each of which a respective ink fountain is located. In addition to a ductor roller, an ink fountain has, in particular, an ink fountain base and two side panels, which together form an ink chamber that is open toward the top. This means that in the ink fountain, only a single gap is formed for the printing ink to reach the ductor roller, i.e., in particular no opposing sealing blade is provided. Preferably, a plurality of ink slides are formed along the ink fountain base, which faces the ductor roller, with said ink slides, together with the ductor roller, forming an ink outlet gap. In the region of the ink slide, or preferably of the ink slides, and/or in the region of a gap between an end wall and the ductor roller, pneumatic means are provided for sealing the ink fountain or the ink chamber with respect to the printing ink held in the ink fountain. The pneumatic means may be formed by a compressed gas line, for example cooperating bore holes.

In particular, it is advantageous that a dynamic counterpressure can be built up in the gaps between the ink slides by a preferably continuous forcing in of compressed gas, in particular compressed air, and this counterpressure counteracts the hydrostatic pressure of the ink, especially the UV printing ink, in an ink fountain, and prevents it from penetrating into the gap. Pressurization with compressed gas can make greasing the ink slides superfluous, thereby substantially reducing the amount of work required to service the ink fountain.

A compressed gas line can preferably be formed largely by bore holes that extend through the ink slides from one flank to the other. The flanks of the slides, in particular the ink slides, are preferably arranged opposite one another in parallel. Since the bore holes overlap one another from one ink slide to the next, a continuous line or compressed gas line is formed.

If one or more ink slides are arranged in a row between end walls of the ink fountain, a gap that is delimited by opposing, in particular parallel flanks of one of the end walls and of the ink slide can be pressurized with compressed gas via a compressed gas line, or via the compressed gas line, and thereby kept free of ink.

The compressed gas line can comprise a bore hole in at least one end wall of the ink fountain. The end wall is well suited for placing a supply connection there for the infeed of the compressed gas.

Such a supply connection can be formed, in particular, by a pneumatic plug-in connector.

BRIEF DESCRIPTION OF THE DRAWINGS

In the following, the invention will be explained by way of example. The accompanying drawings schematically depict.

DESCRIPTION OF THE PREFERRED EMBODIMENT

Figure 1:
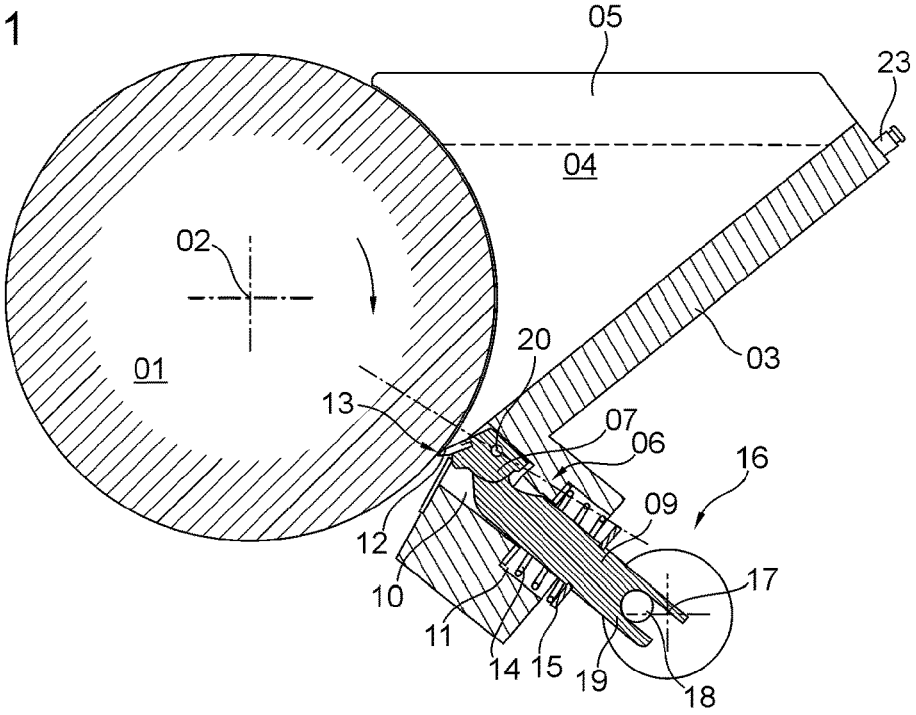
FIG. 1: a schematic section I-I through an ink fountain along a first plane, which is perpendicular to the axis of the ductor roller.

In the case of a sheet-processing machine (not shown in further detail), for example a sheet-fed rotary offset printing machine, specifically in a unit-based and inline configuration, one or more printing units and, where appropriate, one or more coating units can be provided, in which corresponding reservoirs are arranged. In particular, in a respective printing unit a reservoir can be embodied as an ink fountain, which comprises a ductor roller 01, side walls, and an ink fountain base 03, which together delimit an ink chamber 04 for printing ink, in particular UV printing ink, which is open toward the top. In addition, a cover or the like may also be provided over the ink fountain. The machine preferably has dryers for the printing ink that is applied to the substrate, in particular printing substrate, for example sheets or webs of paper, film, or the like. In particular, UV dryers or UV interdeck dryers are provided in the machine for drying or curing the UV printing ink that is preferably used.

At least one, but preferably a plurality of ink slides 06 of the ink fountain, arranged along the margin of the ink fountain base 03, together with the ductor roller 01 form an ink outlet gap 13 for the printing ink, through which the printing ink is conveyed, for example via an inking roller train in the printing unit, to a forme cylinder or plate cylinder. In a medium-format machine, approximately thirty-five ink slides 06 may be arranged side by side in a row, for example, so that a corresponding number of individually controllable inking zones are formed. In large-format machines, more ink slides 06, for example up to forty-nine or more ink slides 06, may be used.

The inking unit in the printing unit may be configured as a film-type inking unit, for example, or preferably as a vibrator-type inking unit, in which the ductor roller 01 (also called the ink fountain roller) cooperates with a vibrator inking roller, which transfers the printing ink to the subsequent rollers of the inking roller train. The rollers of the inking roller train may include known distribution and oscillator rollers, which distribute the printing ink as uniformly as possible. The inking roller train may further include inking rollers that are in surface contact with the plate cylinder and that transfer the printing ink onto a printing plate clamped to the plate cylinder. The inking unit can also be embodied as an inking and dampening unit, with a dampening unit. The ductor roller 01 may have its own drive for driving the ductor roller in printing operation, for example. Said drive may be configured, in particular, as an individual ductor drive that drives the rotation exclusively of the ductor roller 01. However, the individual drive may also drive the ductor roller 01 by means of transmission gearing.

Figure 2:
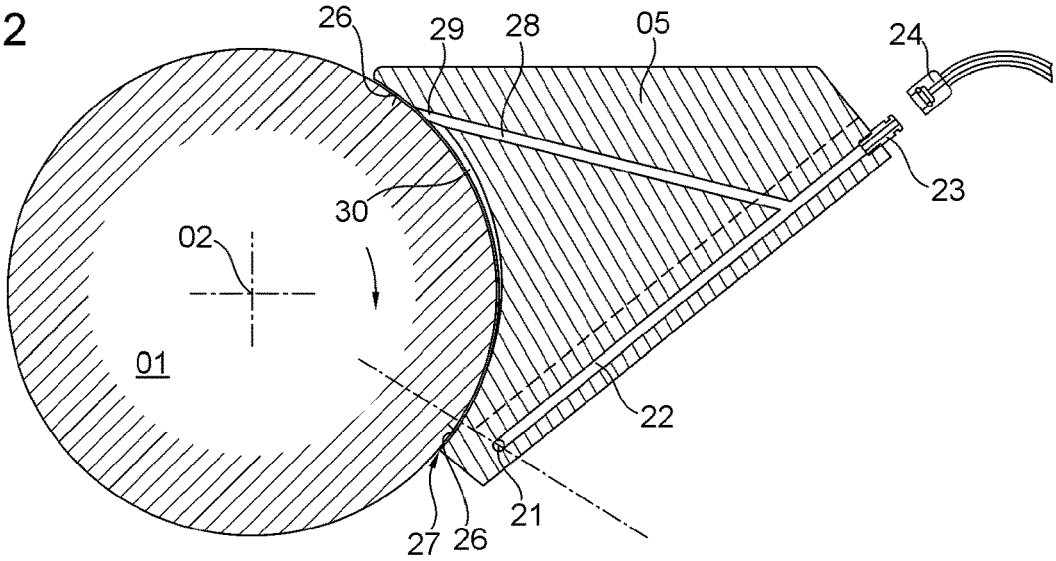
FIG. 2: a schematic section II-II through an ink fountain along a second plane, which is perpendicular to the axis of the ductor roller.

FIG. 1 shows, by way of example, an ink fountain for a printing machine, in particular a sheet-fed printing machine, for example as described above, comprising a ductor roller 01, which is driven rotationally in a clockwise direction about an axis 02 that is perpendicular to the plane of FIGS. 1 and 2, and also comprising an ink fountain base 03 that slopes toward the ductor roller 01. Ductor roller 01 and ink fountain base 03 form the long sides of an ink chamber 04. End faces of the ink chamber 04 are formed by end walls 05; the sectional plane II-II of FIG. 2 extends in one of these end walls 05. The end walls 05, the ink fountain base 03, and/or the ink slide 06 of the ink fountain may be in direct contact with the printing ink, in particular UV printing ink. Alternatively, one, or more, or all of these elements may be in indirect contact with the ink, for example via a film or the like in the ink fountain.

At least one, and particularly multiple ink slides 06 are preferably arranged in a row along the lower margin of the ink fountain base 03, which faces the ductor roller 01. The ink slides 06 each have a roughly cuboid head 07, for example, with an end face that extends obliquely toward the ductor roller 01, and two flanks 08 oriented perpendicular to the axis 02 (see FIG. 3), and a shank 09 that extends radially outward from the axis 02. The heads 07 of the ink slides 06 are held, for example, in a channel 10 extending in the direction of the axis 02 at the lower margin of the ink fountain base 03, the diameter of the shanks 09 is smaller than the distance between the flanks 08 of a head 07, and the shanks 09 run in bore holes 11 that extend from the base of the channel 10 radially outward from the axis 02.

One end face of each head 07 is in direct contact with the ink of the ink chamber 04. One edge of this end face facing the ductor roller 01 is preferably formed by a bar 12 made of a wear-resistant material, such as hard metal. The width of an ink outlet gap 13 between the bar 12 and the ductor roller 01 is a few 10 μm. Thus, by adjusting the distance of the bar 12 from the lateral surface of the ductor roller 01 (ink outlet gap 13), the film thickness of the printing ink emerging from the ink fountain in the relevant ink zone is adjusted. Some or all of the heads 07 or ink slides 06 can preferably be embodied as identical in construction.

Accommodated in the bore hole 11 is a spring 14, in particular, which exerts a force directed away from the axis 02 on the ink slide 06, and which holds the ink slide 06 abutted against an adjustment device 16. The spring 14 may be a helical spring, in particular, which extends around the shank 09 and is clamped between a shoulder of the bore hole 11 and a snap ring 15 fitted onto the shank 09.

The adjustment device 16 of each ink slide 06 can be actuated independently of the other adjustment devices 16, enabling the width of the ink outlet gap 13 to be controlled zonally. In the case shown here, the adjustment device 16 comprises a pin 18, which can be rotated eccentrically about an axis 17 that is parallel to the axis 02, and which engages in a fork 19 at the end of the shank 09 opposite the head 07. Alternatively, however, the adjustment device 16 may transmit an adjusting movement to the ink slide 06 in another way, for example via a contoured surface. In particular, an adjustment device 16 can displace or pivot an ink slide 06 about a pivot axis arranged parallel to the axis 02 or the axis of rotation of the ductor roller 01.

A bore hole 20 extends through the heads 07 of the ink slides 06, parallel to the axis 02 or the axis of rotation of the ductor roller 01. The diameter of the bore hole 20 may be greater than the range of shifting movement of the ink slides 06, to ensure that in every position that the ink slides 06 might assume relative to one another, the bore holes 20 thereof will overlap.

Figure 3:
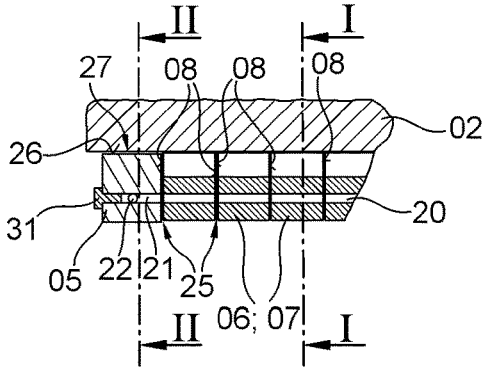
FIG. 3: a partial section through an ink fountain along a plane spanned by the axis of the ductor roller.

As is clear from FIG. 3, the bore holes 20 also overlap with an axial bore hole 21 in at least one end wall 05. This axial bore hole 21 communicates with a bore hole 22 that runs in the sectional plane of FIG. 2. Bore hole 22 ends here, for example, with a pneumatic plug-in connector 23 on an edge of the end wall 05 that faces away from the axis 02. Together, the bore holes 20, 21, 22 form a compressed gas line. The plug-in connector 23 is provided for connection to a compressed air source, such as a compressor, via a complementary connector 24. Alternatively, however, the pneumatic connection may also be produced at a different location and/or with correspondingly suitable connections. When connected, the compressed air source can supply a pressure of at least approximately two bar, for example, at the ink fountain.

The flanks 08 of the ink slides 06 and the interior sides of the end walls 05 opposite an ink slide 06 are preferably polished, in order to minimize the width of gaps 25 between the heads 07 and between an end wall 05 and the head 07 adjacent to it, and thus to minimize the tendency of the ink in the ink chamber 04 to penetrate into the gap 25. Generally, such penetration cannot be fully suppressed in this way, since capillary forces promote penetration into the gap 25. However, by supplying compressed air via the bore holes 22, 21 to the bore holes 20, an air flow directed radially outward from each of the bore holes 20 is maintained in the gaps 25, which generates a positive pressure in the gaps 25 that counteracts the penetration of the ink. In a further refinement, the air flow emerging in the gap 25 can also be directed or at least limited in some areas in particular by the shaping the head 07.

The air flow is stronger the wider the gap 25 is, so that any residual waviness of the mutually opposing polished flanks 08 is automatically compensated for by an increased air flow. The requirements in terms of the planarity of the flanks 08 can therefore be less stringent than for an ink fountain in which the gaps 25 are sealed by a stationary layer of grease.

Each of the end walls 05 has a concave edge 26, which acts as a sealing surface and lies opposite the lateral surface of the ductor roller 01. As is the case between the ink slides 06, a gap 27 between this edge 26 and the lateral surface should be as narrow as possible in order to counteract a penetration of the ink into the gap 27. According to a preferred embodiment, extending between this edge 26 and the bore hole 22 within the end wall 05 is a branch bore hole 28, via which compressed air is also supplied to the gap 27. Since the rotation of the ductor roller 01 promotes the spreading of the air in the gap 27 in the direction of rotation, the starting point 29 of the branch bore hole 28 can be located at an upper end of the edge 26.

On the edge 26, a groove 30 extending in the circumferential direction can be provided, to promote the distribution of the compressed air along the edge 26 and to keep the gap 27, in particular near the lower end of said edge and spaced a significant distance from the starting point 29 of the branch bore hole 28, free of ink.

To simplify production of the end walls 05, the two can be provided with identical bore holes 21, 22, 28. The axial bore hole 21 extends from one main surface of the end wall 05 to the other, and in each case is provided with a seal 31 at its end that faces away from the ink slides 06. The bore holes 20 of the ink slides 06 can then be pressurized with compressed air from both sides. This may be necessary to ensure an adequate supply of compressed air to all gaps 25 and/or gaps 27 in cases in which the bore holes 20 are so narrow or the overlap between them is so small that a noticeable drop in pressure over the length of the assembly of ink slides 06 would occur if the compressed air is supplied into the bore holes 20 via only one end wall 05.

Preferably, however, the outflow of air from the bore holes 20 via gap 25 or gap 27 should be small enough that no appreciable drop in pressure occurs along the bore holes 20, not least to prevent air bubbles from rising within the ink of the ink chamber 04, which could lead to fluctuations in the ink film thickness if they were to pass through the ink outlet gap 13. For example, the gap 25 located between two end walls 05 and/or the gap 27 located between end walls 05 and ductor roller 01 can be dimensioned such that a drop in pressure across the gaps 25, 27 is limited to a value, in particular 25%.

Figure 4:
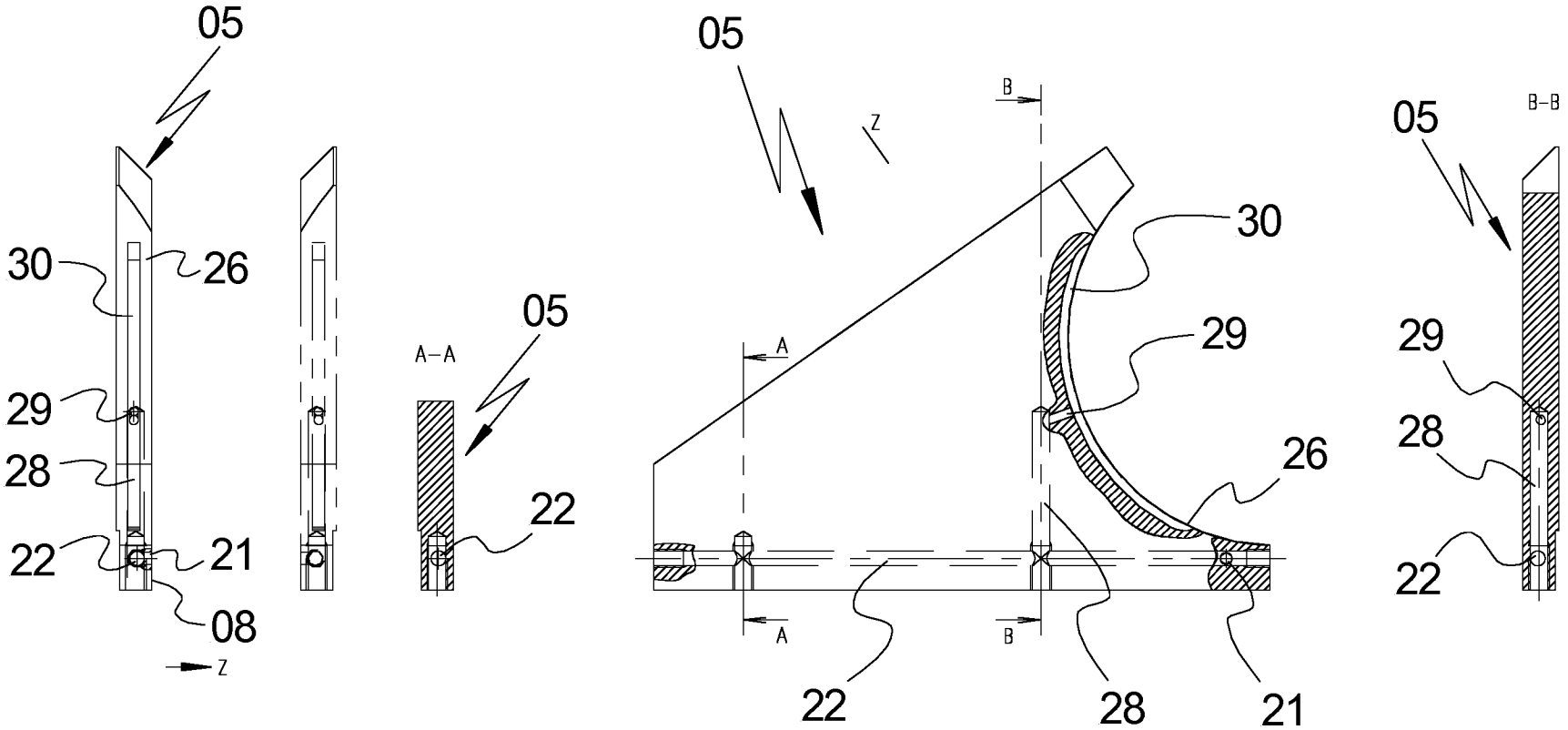
FIG. 4: an embodiment of an operator-side end wall of an ink fountain.

FIG. 4 shows an embodiment of an end wall 05 of an ink fountain in a printing unit of a processing machine, in particular an offset printing machine, preferably a sheet-fed rotary offset printing machine in unit-based and inline configuration, for example as described above. The end wall 05 may be located on the operator side of the machine, for example, and can delimit the ink chamber 04 of the ink fountain. The end wall 05 has a bore hole 22, which communicates with a bore hole 21 that supplies bore holes 20 of ink slides 06. Here, the bore hole 21 is arranged only in the flank 08 of the end wall 05 that faces the ink slides 06, and at some points is embodied as discontinuous.

At an angle, in particular orthogonally, to the bore hole 22, a further bore hole is provided, in particular a branch bore hole 28, which, together with an additional bore hole, forms a starting point 29 for a groove 30 in the sealing surface of the end wall 05 that points toward the ductor roller 01, in particular in the edge 26 thereof that points toward the ductor roller 01. Here, in particular, the groove 30 runs along the concave edge 26 of the end wall 05. The starting point 29 is located, in particular, approximately centered relative to the groove 30, so that the negative pressure forms uniformly along the groove 30 beginning from the starting point 29. The groove 30 may have a uniform depth, in particular, and/or a width of approximately 3 mm, for example. At one end or preferably at both ends, the groove 30 may be embodied as having a radius of curvature of 10 mm, for example. In the depicted embodiment, the bore hole that forms the starting point 29 can be introduced into the end wall 05 at an angle of at least approximately 20° relative to horizontal and/or can have a diameter of at least approximately 3 mm.

The end wall 05 can have a further bore hole, as shown here in section A-A. This bore hole can be used additionally or alternatively for pneumatic supply to the bore hole 22 of the end wall. If this bore hole is used for pneumatic supply, the intake opening to the bore hole 22 is preferably sealed. The intake opening of the branch bore hole 28 shown in section B-B is likewise sealed during operation of the machine.

Figure 5:
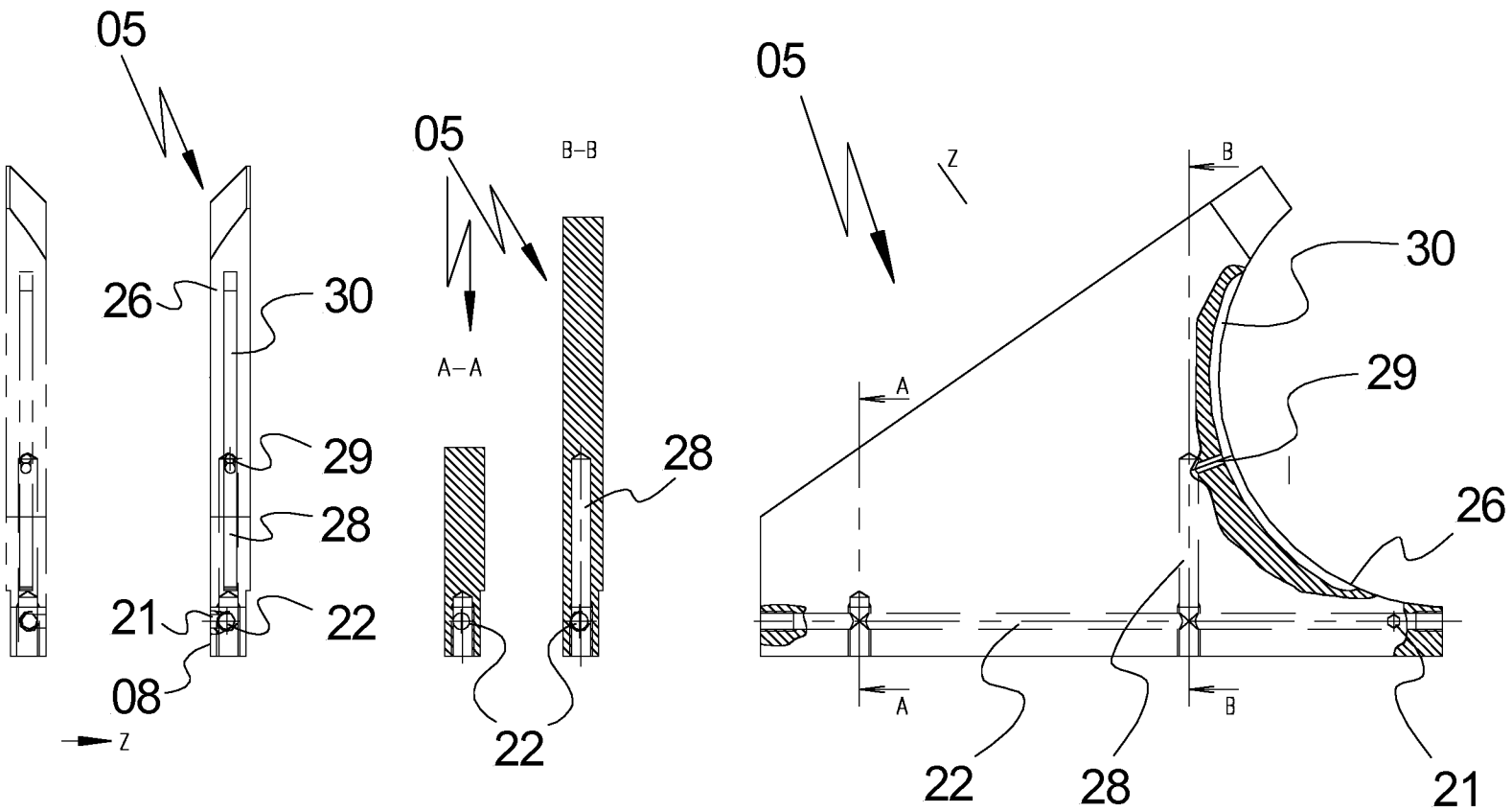
FIG. 5: an embodiment of a drive-side end wall of an ink fountain.

FIG. 5 shows an embodiment of an end wall 05, in particular of the ink fountain, as described above. The end wall 05 may be located, for example, on the drive side of the machine and can delimit the ink chamber 04 of the ink fountain. The end wall 05 has a bore hole 22, which communicates with a bore hole 21 that supplies bore holes 20 of ink slides 06. Here, the bore hole 21 is arranged only in the flank 08 of the end wall 05 that faces the ink slides 06, and at some points is embodied as discontinuous.

At an angle, in particular orthogonally, to the bore hole 22, a further bore hole is provided, in particular a branch bore hole 28, which, together with an additional bore hole, forms a starting point 29 for a groove 30 in the sealing surface of the end wall 05 that points toward the ductor roller 01, in particular in the edge 26 thereof that points toward the ductor roller 01. Here, in particular, the groove 30 runs along the concave edge 26 of the end wall 05. The starting point 29 is located, in particular, approximately centered relative to the groove 30, so that the negative pressure forms uniformly along the groove 30 beginning from the starting point 29. The groove 30 may have a uniform depth, in particular, and/or a width of approximately 3 mm, for example. At one end or preferably at both ends, the groove 30 may be embodied as having a radius of curvature of 10 mm, for example. In the depicted embodiment, the bore hole that forms the starting point 29 can be introduced into the end wall 05 at an angle of at least approximately 20° relative to horizontal and/or can have a diameter of at least approximately 3 mm.

The end wall 05 can have a further bore hole, as shown here in section A-A. This bore hole can be used additionally or alternatively for pneumatic supply to the bore hole 22 of the end wall. If this bore hole is used for pneumatic supply, the intake opening to the bore hole 22 is preferably sealed. The intake opening of the branch bore hole 28 shown in section B-B is likewise sealed during operation of the machine.

The two end walls 05 can be attached one on either side of the ink fountain base 03, for example, thereby forming, together with the ink fountain base 03 and the ductor roller 01, the ink chamber 04, which is open toward the top and in which the medium, in particular the printing ink, especially UV printing ink, is held. The ink fountain thus preferably comprises exactly the two end walls 05, which in particular are configured as a single piece, or as integral.

Compressed gas, in particular compressed air, is supplied in particular to both end walls 05 via pneumatic connections, for example the plug-in connectors 23. The compressed gas, in particular the compressed air, can be fed in, for example, through one or two connectors 24, which can be removed from the plug-in connector 23. A constant pressure of approximately two bar, for example, can thus be applied to both sides. Moreover, the intensity and/or the duration of action of the compressed gas, in particular the compressed air, can also be adjusted and/or modified as needed. In particular, however, the intensity and/or the duration of action of the compressed gas, in particular the compressed air, is selected such that a sufficient flow of air is generated at all gaps 25, 27 of the reservoir, in particular the ink fountain, producing a sealing effect with respect to the medium, in particular the printing ink.

The slide(s), in particular ink slide(s) 06, can also be shifted in the presence of the compressed gas, in particular the compressed air, in order to adjust the outlet gap 13. If multiple slides, in particular ink slides 06, are provided, these are displaced individually by separate adjustment devices 16 in order to adjust the respective outlet gap 13, with the roller, in particular ductor roller 01, being rotationally driven about the axis 02 during operation of the machine.

While a processing machine, having a unit with a reservoir, and a method for operating such a reservoir have been set forth fully and completely herein above, will be apparent to one of skill in the art the various changes could be made thereto, without departing from the true spirit and scope of the present invention, which is accordingly to be limited only by the appended claims.

The invention claimed is:

1. A processing machine comprising:

a printing unit;

an ink fountain in the printing unit, the ink fountain including a ductor roller, an ink fountain base, and spaced end walls which cooperate to define an ink chamber for receipt of a printing ink, wherein the ink fountain is open toward the top;

one or more ink slides arranged along a margin of the ink fountain base to form, together with the ductor roller, an ink outlet gap for the printing ink;

pneumatic means in at least one of a gap in a region of edges of adjacent ones of the ink slides and in a region between an edge of one of the ink slides and a side of an adjacent one of the spaced end walls and in a region of an edge between an end wall and the ductor roller, the pneumatic means being provided to seal the gaps in the ink chamber with respect to the printing ink;

a positive pressure, which positive pressure is formed by the pneumatic means and is elevated in relation to an ambient pressure, and which positive pressure counteracts a penetration of the printing ink into the gaps between one of adjacent ones of the one or more ink slides and between an ink slide and an end wall, and between the edge of one of the spaced end walls and the ductor roller, the positive pressure being generated in the one of the gaps between the ones of the ink slides and the gaps between one of the spaced end walls and one of the ink slides and in the gaps between ones of the spaced end walls and the ductor roller;

a compressed gas line formed by bore holes in ones of the ink slides and in the end walls wherein the positive pressure is generated in the gaps between the end walls and the ductor roller and between adjacent ones of the ink slides and between the end walls and adjacent ones of the ink slides by the supply of a compressed gas to the compressed gas line.

2. The processing machine according to claim 1, wherein the positive pressure extends from one of the spaced end walls to an opposite one of the spaced end walls that delimit the ink chamber.

3. The processing machine according to claim 1, wherein one of flanks of ink slides and of end walls and of the adjacent ones of the ink slides lie opposite one another in pairs, parallel to one another.

4. The processing machine according to claim 3, wherein at least one of the gaps that are delimited by opposing flanks of two adjacent ones of the one or more ink slides can be pressurized with the compressed gas.

5. The processing machine according to claim 4, wherein the compressed gas line includes the bore holes that extend through each of the one or more ink slides from one flank to the other flank of each of the one or more ink slides.

6. The processing machine according to claim 1, wherein the ink slides are arranged in a row between the spaced end walls of the ink fountain, and a gap delimited by opposing flanks of one of the spaced end walls and one of the ink slides can be pressurized with the compressed gas via the compressed gas line.

7. The processing machine according to claim 1, wherein the ink fountain has exactly two spaced end walls and wherein each of the exactly two spaced end walls has the end wall bore holes of the compressed gas line.

8. The processing machine according to claim 1, wherein the spaced end walls of the ink fountain are exactly two single-piece spaced end walls, and wherein, in each of the exactly two single-piece spaced end walls, branch bore holes are provided for supplying the compressed gas to a groove, which groove is arranged in a sealing surface of each of the exactly two single-piece end walls and facing toward the ductor roller.

9. A method for operating a reservoir in a unit of a processing machine including:

providing a roller, end walls and a base for delimiting a reservoir chamber of the reservoir for a medium, the reservoir chamber receiving a medium;

arranging one or more slides along a margin of the base, to form, together with the roller, an outlet gap for the medium;

providing pneumatic means in the region of the one or more slides, and using the pneumatic means for sealing the reservoir chamber with respect to the medium;

using the pneumatic means for counteracting a penetration of the medium into one of gaps between the one or more slides and into gaps between the end walls of the reservoir and the one or more slides, using compressed gas as the pneumatic means for keeping a gap between flanks of an end wall and a slide and gaps between flanks of slides free of the medium;

providing bore holes in ones of the slides and the end faces and conducting the compressed gas via the bore holes, and wherein the slides are shiftable for adjusting an outlet gap, between ones of the bore holes;

conducting the compressed gas through overlapping ones of the bore holes in every position of the slides; and using the compressed gas for counteracting the penetration of the medium into gaps between the end walls and the roller and, wherein the compressed gas keeps a gap between an end wall and the roller free of the medium, and wherein the compressed gas is conducted via grooves in end faces of the end walls.

10. The method according to claim 9, further including using the compressed gas for keeping a region of the slides below the base outside of the outlet gap free of the medium.

11. The method according to claim 9, further including forcing the compressed gas between ones of flanks of an end wall and of a slide, and between flanks of slides that lie opposite one another in pairs.

12. The method according to claim 9, further including shifting the slides in the presence of the compressed gas, to adjust the outlet gap.

13. The method according to claim 9, further including providing the reservoir as an ink fountain, the base as an ink fountain base, the reservoir chamber as an ink chamber, and the roller as a ductor roller, and wherein a plurality of the one or more slides are shifted in a radial direction relative to the ductor roller to control a width of the outlet gap zonally.

* * * * *